US006152745A

United States Patent [19]

Matsumoto et al.

[11] Patent Number: 6,152,745

[45] Date of Patent: Nov. 28, 2000

[54] SHIELDED-ELECTRIC-WIRE CONNECTION PART STRUCTURE

[75] Inventors: Mitsuhiro Matsumoto; Masahiro Deno, both of Shizuoka-ken, Japan

[73] Assignee: Yazaki Corporation, Tokyo, Japan

[21] Appl. No.: 09/414,704

[22] Filed: Oct. 8, 1999

[30] Foreign Application Priority Data

Oct. 12, 1998 [JP] Japan ..... 10-289684

[51] Int. Cl.[7] ..... H01R 13/648; H01R 13/58; H01R 9/03

[52] U.S. Cl. ..... 439/98; 439/587

[58] Field of Search ..... 439/610, 98, 462, 439/460, 587

[56] References Cited

U.S. PATENT DOCUMENTS

| | | | |
|---|---|---|---|
| 2,639,313 | 5/1953 | Street, Jr. | 174/152 |
| 5,691,506 | 11/1997 | Miyazaki et al. | 174/65 R |
| 6,042,396 | 3/2000 | Endo et al. | 439/98 |

FOREIGN PATENT DOCUMENTS

| | | |
|---|---|---|
| 7-326437 | 12/1995 | Japan . |
| 9-180824 | 7/1997 | Japan . |
| 10-112924 | 4/1998 | Japan . |

*Primary Examiner*—Gary F. Paumen
*Assistant Examiner*—Edwin A. León
*Attorney, Agent, or Firm*—Finnegan, Henderson, Farabow, Garrett & Dunner, L.L.P.

[57] ABSTRACT

A shielded-electric-wire connection part structure includes: a shielded electric wire having a braid wire; an appliance main body being formed with an electric wire insertion through-hole formed with a shield connection portion and an engaging portion; a shield connector being interposed between the electric wire insertion through-hole and the shielded electric wire so that the braid wire is connected to a prescribed position of the electric wire insertion through-hole; an elastic member being interposed between the electric wire insertion through-hole and the shielded electric wire and being formed with a hollow portion through which the shielded electric wire is inserted and passed, the elastic member serving to contact the shield connector with the shield connection portion; and a holding member being formed with another hollow portion through which the shielded electric wire is inserted and passed. In the above construction, the holding member pressurizes the elastic member by being engaged with the engaging portion, thereby pressing the shield connector with respect to the shield connection portion.

6 Claims, 4 Drawing Sheets

SHIELDED-ELECTRIC-WIRE CONNECTION PART STRUCTURE

BACKGROUND OF THE INVENTION

1. Field of the Invention

The present invention relates to a shielded-electric-wire connection part structure that is applied to various electric appliances such as a motor, that has been loaded on, for example, an electric car, a hybrid car, etc. and, more particularly, to a shielded-electric-wire connection part structure, with respect to which shield connection and waterproof are each reliably done.

2. Related Art

In a case where connecting a shielded electric wire, that serves as an electricity-supplying high-voltage electric wire or a control signal electric wire, to a motor that has been loaded on, for example, an electric car, a hybrid car, etc., it is demanded that electro-magnetic shielding or waterproofing be performed. This electro-magnetic shielding is performed in order to prevent the operation of the motor from becoming unstable due to various noises while waterproofing is performed in order to prevent the electric contact parts, etc. from being broken, etc. due to rain droplets, etc. that enters into the motor case by going forward along the shielded electric wire.

A shielded electric wire connection part structure, with respect to which those electro-magnetic shielding and waterproofing have been done, is disclosed in Japanese Patent Application Laid-Open No. Hei 10-112924. Explaining this concretely with reference to FIGS. 1, 2A and 2B, as illustrated in FIG. 1, the shielded-electric-wire connection part structure 1 connects a braid wire 6a of a shielded electric wire 6 to the interior of an electric wire insertion through-hole 2*a* of a motor case 2 serving as an appliance main body via a substantially circular-hollow-cylindrical housing 3, a bolt 4, and a shield connection ring 5 serving as a shield connector. Specifically, in a state where the outer-peripheral surface 3*a* at a forward end portion of the housing 3 is kept fitted in the electric wire insertion through-hole 2*a* of the motor case 2, an attaching flange 3*b* thereof is fastened and fixed by means of a bolt 4. And it is thereby arranged that the housing 3 having had the shielded electric wire 6 passed therethrough be attached to the motor case 2.

Also, as illustrated in FIGS. 2A and 2B, into the outer-peripheral recessed portion 3*c* at the forward end of the housing 3 is folded back the braid wire 6*a* of the shielded electric wire 6 that has been passed through the housing 3. This folded back braid wire 6*a* is clamped by a shield connection ring 5 that is fitted over the outer-peripheral recessed portion 3*c* at the forward end of the housing 3. This shield connection ring 5 is formed in the shape of a cap whose center is open, by the use of metallic material having excellent spring property. Whereby, the folded-back braid wire 6*a* of the shielded electric wire 6 is engaged with and retained by a plurality of spring piece portions 5*a,* that protrude outside, and engaging/retaining piece portions 5*b* so that the shield connection ring 5 may be freely drawn off or prevented from being drawn off from the braid wire 6*a*. Further, the respective spring piece portions 5*a* of the shield connection ring 5 are elastically contacted with the electric wire insertion through-hole 2*a* of the motor case 2. As a result of this, the braid wire 6*a* of the shielded electric wire 6 is earthed via the motor case 2.

Also, into an annular-recess like groove portion 3*d* that has been formed in the outer-peripheral surface 3*a* at the forward end portion of the housing 3 is fitted an O-ring 7 that provides an airtightness between the housing 3 and the motor case 2. Further, between an insulating outer clothing 6*b* of the shielded electric wire 6 and the housing 3 is interposed a substantially hollow-circular-cylindrical waterproof plug 8. It is thereby arranged that rain droplets, etc. be reliably prevented from entering into the motor case 2 from the outside. Also, the shielded electric wire 6 is inserted through the electric wire insertion through-hole 2*a* of the housing 2 in a state of its having been inserted through a corrugate tube 9. Further, a connection terminal not illustrated that is connected to a motor terminal portion not illustrated is bonded and connected to a core wire portion 6*d* that has been exposed from an insulating inner clothing 6*c* of the shielded electric wire 6.

It is to be noted that a similar technique regarding this shielded-electric-wire connection part structure 1 is disclosed in Japanese Patent Application Laid-Open No. Hei 9-180824.

However, in the above-described conventional shielded-electric-wire connection part structure 1, the electric wire insertion through-hole 2*a* of the motor case 2 and the braid wire 6*a* are connected to each other by the spring force of the shield connection ring 5. Therefore, there was the possibility that the seal performance would be deteriorated due to the setting of the spring property of the shield connection ring 5 resulting from the lapse of time, etc. Also, the same surface of the electric wire insertion through-hole 2*a* of the motor case 2 serves both as the shield surface for shielding the braid wire 6*a* of the shielded electric wire 6 and as the waterproof surface that the O-ring 7 contacts with. Therefore, when mounting the housing 3 onto the motor case 2 by the bolt 4, there was the possibility that the waterproof surface would be damaged with the result that the waterproofness became bad. Further, because the housing 3 is mounted on the motor case 2 via the flange portion 3*b* and the bolt 4, it becomes indispensable to ensure the mounting space. As a result, the entire structure became large in size.

SUMMARY OF THE INVENTION

The present invention has been made in view of the above and has an object to provide a shielded-electric-wire connection part structure which can reliably perform shield connection and waterproofing and decrease the space for it as a whole.

To attain the above object, a first aspect of the present invention provides a shielded-electric-wire connection part structure comprising: a shielded electric wire having a braid wire; an appliance main body being formed with an electric wire insertion through-hole therein for permitting the insertion and passage therethrough of the shielded electric wire at a prescribed position, the electric wire insertion through-hole having a shield connection portion and an engaging portion; a shield connector being interposed between the electric wire insertion through-hole and the shielded electric wire so that the braid wire is connected to a prescribed position of the electric wire insertion through-hole; an elastic member being interposed between the electric wire insertion through-hole and the shielded electric wire, the elastic member being formed with a hollow portion through which the shielded electric wire is inserted and passed, the elastic member serving to contact the shield connector with the shield connection portion; and a holding member being interposed between the electric wire insertion through-hole and the shielded electric wire, the holding member being formed with another hollow portion through which the shielded electric wire is inserted and passed, the holding member pressurizing the elastic member by being engaged with the engaging portion, thereby pressing the shield connector with respect to the shield connection portion.

In the shielded-electric-wire connection part structure according to the first aspect, by being elastically urged by the hollow elastic member that is pressurized by the hollow holding member through which the shielded electric wire is passed, the shield connector having the braid wire of the shielded electric wire connected thereto is contacted with the shield connection portion of the electric wire insertion through-hole of the appliance main body. Therefore, the shield connection between the appliance main body and the braid wire of the shielded electric wire is reliably performed, with the result that the seal performance is enhanced. Also, the hollow holding member is engaged with and retained by the engaging portion that has been provided on the same axis as that of the electric wire insertion through-hole of the appliance main body so as to make a shield connection of the braid wire of the shielded electric wire to the appliance main body. Therefore, the space for the occupation of the shielded-electric-wire connection part structure can be decreased and the entire structure is miniaturized.

According to a second aspect of the present invention, as it depends from the first aspect, there is provided a shielded-electric-wire connection part structure, wherein the hollow holding member has a flexible engaging/retaining portion which is engaged with and retained by the engaging portion, at a position opposing to the engaging portion of the electric wire insertion through-hole.

In the shielded-electric-wire connection part structure, the attachment of the shielded electric wire to the appliance main body is performed by the simple operation of causing the flexible engaging/retaining portion of the hollow holding member to be engaged with and retained by the engaging portion of the electric wire insertion through-hole of the appliance main body. Therefore, the connecting operation efficiency of connecting the electric wire to the shield connection portion of the electric wire insertion through-hole of the appliance main body is enhanced.

According to a third aspect of the present invention, as it depends from the first aspect or the second aspect, there is provided a shielded-electric-wire connection part structure, wherein a slant portion is provided on the shield connection portion of the electric wire insertion through-hole; and a slant portion of the shield connector is pressed against and contacted with the slant portion of the shield connection portion.

In this shielded-electric-wire connection part structure, by being elastically urged by the hollow elastic member that is pressurized by the hollow holding member through which the shielded electric wire is passed, the slant portion of the shield connector having the braid wire of the shielded electric wire connected thereto is reliably contacted with the slant portion of the shield connection portion of the electric wire insertion through-hole of the appliance main body. Therefore, the shield connection between the appliance main body and the braid wire of the shielded electric wire is reliably performed, with the result that the seal performance is enhanced.

According to a fourth aspect of the present invention, as it depends from one aspect among the first aspect to the third aspect, there is provided a shielded-electric-wire connection part structure, wherein the hollow elastic member is made of a rubber material; a plurality of convexities are formed on each of the inner- and the outer-peripheral surface of this hollow rubber member; the electric wire insertion through-hole has a seal surface; the convexities formed on the inner-peripheral surface of this hollow rubber member are respectively made freely pressure contactable with an insulating outer clothing of the shielded electric wire; and the convexities formed on the outer-peripheral surface of this hollow rubber member respective convexities are respectively made freely pressure contactable with the seal surface of the electric wire insertion through-hole.

In the shielded-electric-wire connection part structure, when inserting the shield connector into the electric wire insertion through-hole of the appliance main body, there is no possibility of damaging the seal surface (waterproof surface) of the electric wire insertion through-hole due to the slant portion of the shield connector. Therefore, the waterproof between the shielded electric wire and the electric wire insertion through-hole of the appliance main body is reliably achieved by the respective convexities of the inner- and the outer-peripheral surface of the hollow rubber member.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENT

Figure 1:
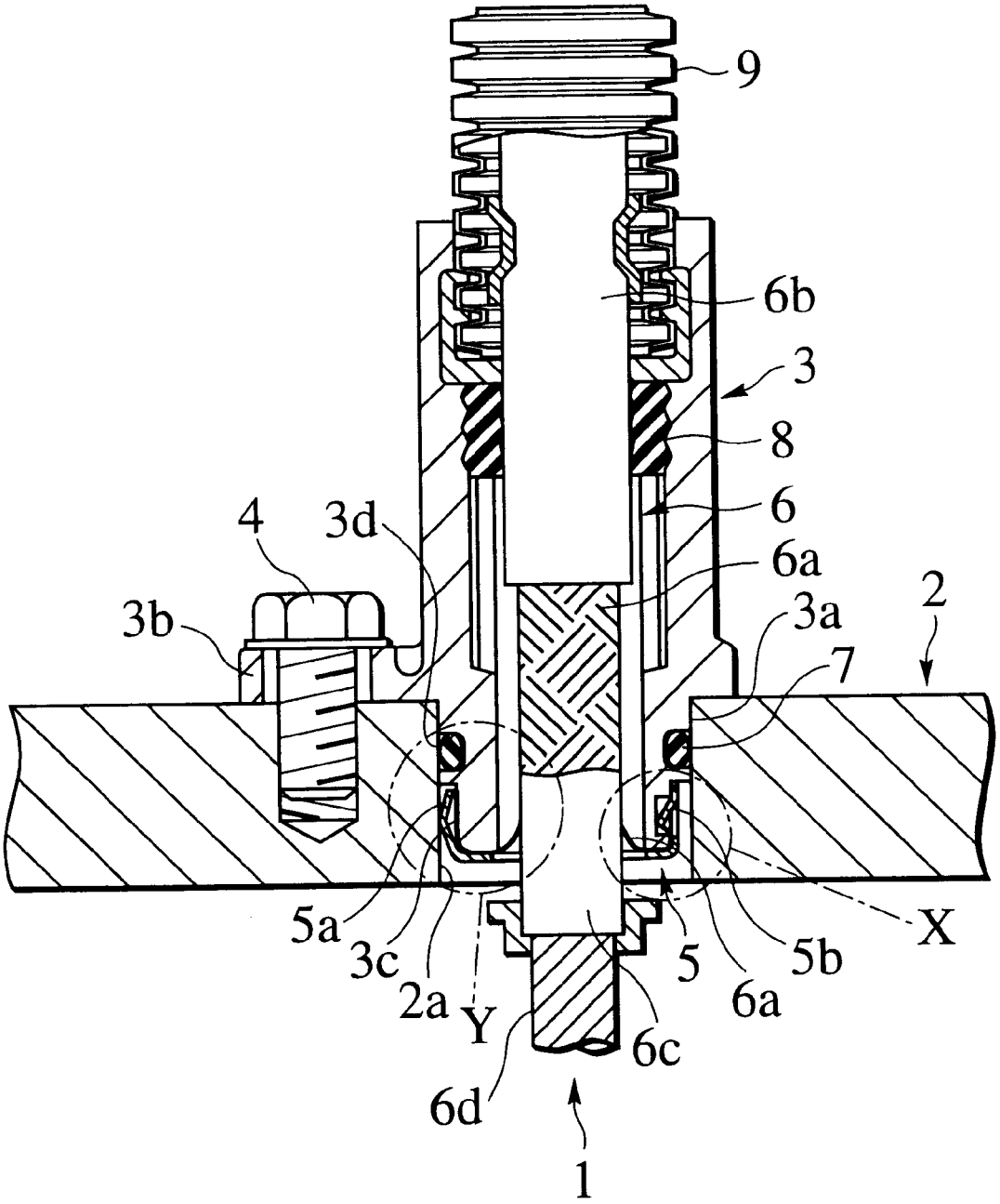
FIG.1 PRIOR ART
FIG. 1 is a sectional view illustrating a conventional shielded-electric-wire connection part structure.
Figure 2A:
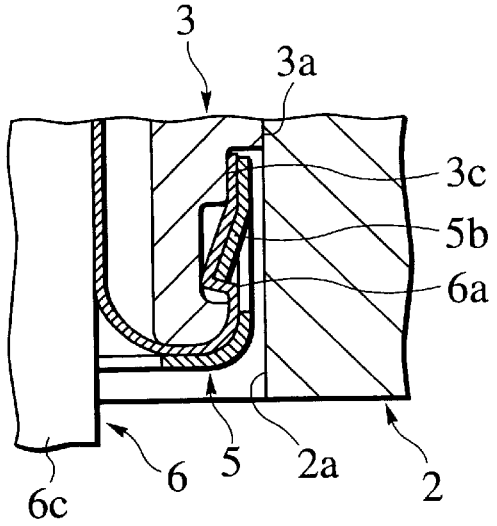
FIG.2A PRIOR ART
FIG. 2A is an enlarged sectional view of an X portion of FIG. 1.
Figure 2B:
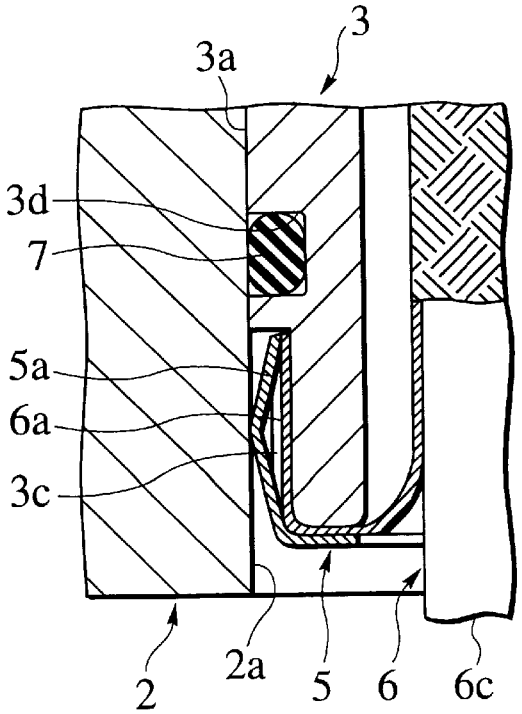
FIG.2B PRIOR ART
FIG. 2B is an enlarged sectional view of a Y portion of FIG. 1.

There will be detailed below the preferred embodiments of the present invention with reference to the accompanying drawings. Like members are designated by like reference characters.

An embodiment of the present invention will be explained with reference to the drawings.

Figure 3:
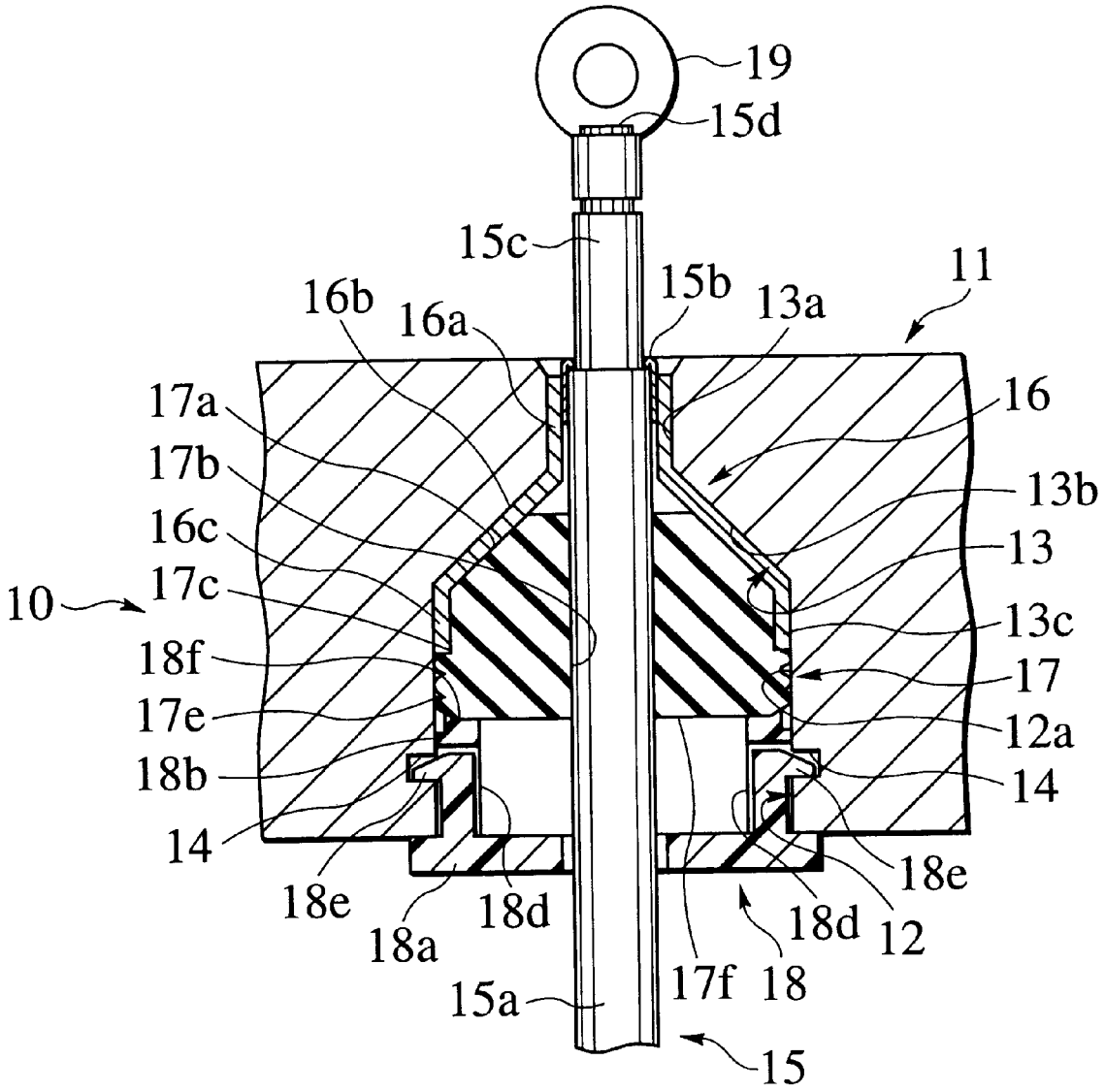
FIG. 3 is a sectional view illustrating a shielded-electric-wire connection part structure according to an embodiment of the present invention.
Figure 4:
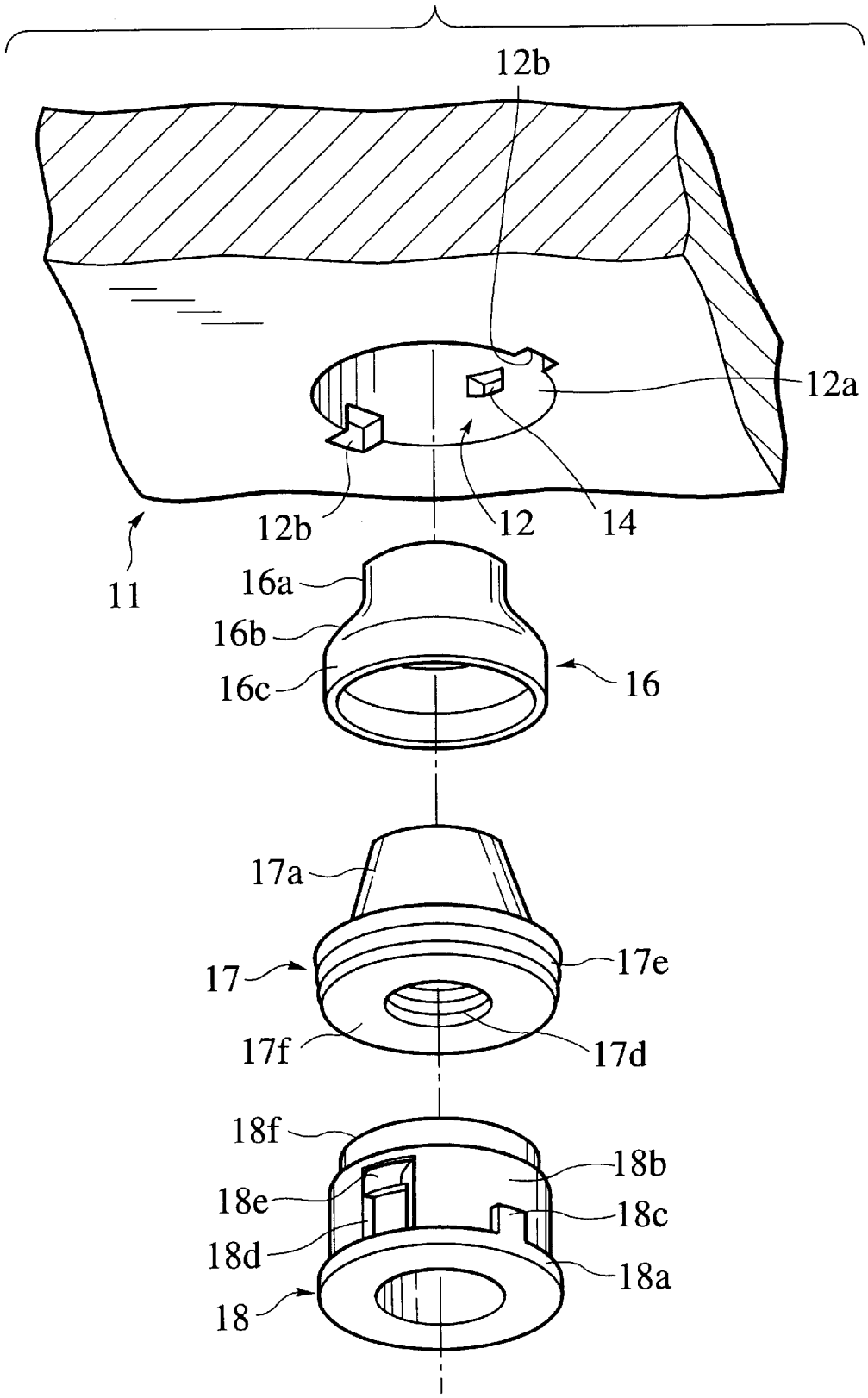
FIG. 4 is an exploded perspective view of a main part of the shielded-electric-wire connection part structure.

FIG. 3 is a sectional view illustrating a shielded-electric-wire connection part structure according to an embodiment of the present invention; and FIG. 4 is an exploded perspective view of a main part of this shielded-electric-wire connection part structure.

A shielded-electric-wire connection part structure 10 illustrated in FIG. 3 is the one which is applied to a motor (not illustrated) that has been loaded on, for example, an electric car or a hybrid car (not illustrated either). Electromagnetic shielding, waterproofing, etc. are performed with respect to the structure 10. Namely, the shielded-electric-wire connection part structure 10 has an electric wire insertion through-hole 12 formed therein at a prescribed position of an electrically conductive motor case (appliance main body) 11. And a braid wire 15*b* of a shielded electric wire 15, which has been passed through the electric wire insertion through-hole 12 and which serves as an electricity-supplying high-voltage electric wire or a control-signal electric wire, is connected to a prescribed position of the electric wire insertion through-hole 12 via an electrically conductive shield terminal (shield connector) 16, a hollow rubber member (hollow elastic member) 17, and a hollow rear holder (hollow holding member) 18 that is made of synthetic resin. And the braid wire is thereby earthed.

As illustrated in FIGS. 3 and 4, the electric wire insertion through-hole 12 is so formed as to be passed through the motor case 11 having a large thickness. The insertion through-hole 12 has formed therein a shield connection portion 13 for permitting the shield terminal 16 to be accommodated within the electric wire insertion through-hole 12 and connected thereto and engaging holes 14 for permitting the rear holder 18 to be engaged therewith. The shield connection portion 13 is composed of a small-diameter portion 13*a*, a conical-surface like slant portion 13*b*, and a large-diameter portion 13*c*. It is arranged that respective portions 16*a* to 16*c* of the shield terminal 16 as later described are brought into surface contact with those respective portions 13*a* to 13*c*. Also, the large-diameter portion 13*c* of the shield connection portion 13 connects to a seal surface 12*a* of the electric wire insertion through-hole 12 in such a form as to become integral (flush) with the seal surface. At the positions, spaced 180 degrees from each other, of the seal surface 12*a* of the electric wire insertion through-hole 12 are respectively formed rectangular engaging holes 14. Further, at the positions, spaced 90 degrees from the positions corresponding to the respective engaging holes 14, of the rear end edge of the seal surface 12*a* of the electric wire insertion through-hole 12 are respectively formed positioning recessed portions 12*b*.

The shielded electric wire 15 is constructed of an insulating outer clothing 15*a*, a braid wire 15*b* that has been covered by the insulating outer clothing 15*a*, an insulating inner clothing 15*c*, and a core wire portion 15*d* that consists of conductor that has been clothed by the insulating inner clothing 15*c*. To the core wire portion 15*d* that has been exposed from the insulating inner clothing 15*c* of the shielded electric wire 15 is pressure bonded a connection terminal 19 that is connected to a motor terminal portion not illustrated.

The shield terminal 16 performs electric connection between the braid wire 15*b* of the shielded electric wire 15 and the motor case 11. The shield terminal 16 is formed substantially as a funnel that consists of a small-diameter hollow-cylindrical portion 16*a*, a conical slant portion 16*b*, and a large-diameter hollow-cylindrical portion 16*c*. It is arranged that, when having inserted the shield terminal 16 through the electric wire insertion through-hole 12, the slant portion 16*b* thereof be brought into surface contact with the slant portion 13*b* of the shield connection portion 13 while the small- and large-diameter hollow-cylindrical portions 16*a*, 16*c* thereof are brought into surface contact with the small- and large-diameter portions 13*a*, 13*c* of the shield connection portion 13. Also, within the small-diameter hollow-cylindrical portion 16*a* of the shield terminal 16 is fixed the braid wire 15*b* of the shielded electric wire 15. Namely, within the small-diameter hollow-cylindrical portion 16*a* of the shield terminal 16 is inserted the braid wire 15*b* that has been folded back onto the insulating outer clothing 15*a* side of the shielded electric wire 15, the braid wire 15*b* being then fixed by being caulked.

The hollow rubber member 17 is intended to press the shield terminal 16 against the shield connection portion 13 side of the electric wire insertion through-hole 12 by its elastically urging force. The hollow rubber member 17 is formed substantially as a hollow-circular-cylindrical member that is thick and that has a conical surface 17*a* at its forward end side. On each of the inner- and outer-peripheral surfaces 17*b*, 17*c* of the hollow rubber member 17 are formed integrally therewith a plurality of convex portions 17*d* and 17*e* projectingly. The respective convex portions 17*d*, 17*e* are made freely pressure contactable with the insulating outer clothing 15*a* of the shielded electric wire 15 and the seal surface 12*a* of the electric wire insertion through-hole 12, respectively. As a result of this, waterproof is made between the shielded electric wire 15 and the electric wire insertion through-hole 12 of the motor case 11.

The hollow rear holder 18 is equipped with a circular-disk-shaped and annular flange portion 18*a* and a hollow-circular-cylindrical portion 18*b* that has been integrally formed projectingly from the flange portion 18*a*. And it is arranged that the shielded electric wire 15 be inserted through the interior of the rear holder 18. Also, at those positions of the flange portion 18*a* of the hollow rear holder 18 that oppose the pair of positioning recessed portions 12*b*, 12*b* of the electric wire insertion through-hole 12 are integrally formed projectingly a pair of positioning convex portions 18*c*. Further, at those positions of the circular-cylindrical portion 18*b* of the hollow rear holder 18 that oppose the pair of engaging holes 14, 14 of the electric wire insertion through-hole 12 are respectively formed horizontally-thrown-U-shaped slits 18*d*. Within these respective slits 18*d* are respectively integrally formed projectingly substantially-L-shaped flexible engaging pawls (flexible engaging/retaining portions) 18*e* that are engaged with and retained by the engaging holes 14. It is to be noted that when the hollow rear holder 18 is fitted into the electric wire insertion through-hole 12 and engaged with and retained by the same, it is arranged that a rear surface 17*f* side of the hollow rubber member 17 be pressurized by a forward end surface 18*f* of the circular-cylindrical portion 18*b* of the rear holder 18.

According to the shielded-electric-wire connection part structure 10 of this embodiment, the braid wire 15*b* of the shielded electric wire 15 is folded back onto the insulating outer clothing 15*a* side and the braid wire 15*b* is caulked into within the small-diameter cylindrical portion 16*a* of the shield terminal 16. Thereafter, the shield terminal 16 is inserted from the connection terminal 19 side of the shielded electric wire 15 into the electric wire insertion through-hole 12 of the motor case 11. Thereafter, the hollow rear holder 18 having had the shielded electric wire 15 inserted therethrough is fitted into the seal surface 12*a* within the electric wire insertion through-hole 12. At this time, when pushing the hollow rear holder 18 into the electric wire insertion through-hole 12 of the motor case 11 with the pair of positioning convex portions 18*c*, 18*c* of the former being fitted in the pair of positioning recessed portions 12*b*, 12*b* on the opening edge side of the latter, the pair of flexible engaging/retaining pawls 18*e*, 18*e* of the rear holder 18 are engaged with and retained by the pair of engaging holes 14, 14 within the electric wire insertion through-hole 12 of the motor case 11. As a result of this, the rear holder 18 is engaged with and retained by the motor case 11 with one touch.

By the rear holder 18 being engaged and retained, the rear surface 17*f* of the hollow rubber member 17 is pressurized by the forward end surface 18*f* of the rear holder 18. By the elastic urging of the hollow rubber member 17 that is caused by the pressurization of the rear holder 18, the slant portion 16*b* of the shield terminal 16 is pressed against the conical-surface like slant portion 13*b* of the shield connection portion 13 of the electric wire insertion through-hole 12. As a result, the motor case 11 is reliably contacted with the shield terminal 16 having had the braid wire 15*b* of the shielded electric wire 15 connected thereto. At this time, by the respective convexities 17*d,* 17*e* integrally formed projectingly on the inner- and outer-peripheral surfaces 17*b,* 17*c* of the hollow rubber member 17, reliable waterproof is made between the motor case 11 and the shielded electric wire 15.

In this way, since, by the elastic urging of the hollow rubber member 17 pressurized by the hollow rear holder 18 through which the shielded electric wire 15 is passed, the shield terminal 16 having had the braid wire 15*b* of the shielded electric wire connected thereto is reliably contacted with the shield connection portion 13 of the electric wire insertion through-hole 12 of the motor case 11 via the respective slant portions 16*b,* 13*b,* it is possible to reliably achieve the shield connection between the motor case 11 and the braid wire 15*b* of the shielded electric wire 15 and thereby enhance the shielding performance one step more highly. Also, since it has been arranged to make a shield connection of the braid wire 15*b* of the shielded electric wire 15 to the shield connection portion 13 of the electric wire insertion through-hole 12 of the motor case 11 via the shield terminal 16 by causing the respective flexible engaging/retaining pawls 18*e* of the hollow rear holder 18 to be engaged with and retained by their corresponding respective engaging holes 14 that have been provided in the electric wire insertion through-hole 12 of the motor case 11, it is possible to decrease the space for the installation of the shielded-electric-wire connection part structure 10 and also miniaturize of the same as a whole.

Further, since the attachment of the shielded electric wire 15 onto the motor case 11 is performed through a simple operation of causing the respective flexible engaging/retaining pawls 18*e* of the hollow rear holder 18 to be engaged with and retained by their corresponding respective engaging holes 14 of the electric wire insertion through-hole 12 of the motor case 11, it is possible to enhance the connection operation efficiency of connecting the shielded electric wire 15 to the shield connection portion 13 of the electric wire insertion through-hole 12 of the motor case 11. In addition, when inserting the shield terminal 16 into the electric wire insertion through-hole 12 of the motor case 11, this insertion can be smoothly done without damaging the seal surface 12*a* of the electric wire insertion through-hole 12 owing to the slant portion 16*b* of the shield terminal 16. Therefore, reliable waterproof can be done between the shielded electric wire 15 and the electric wire insertion through-hole 12 of the motor case 11 by the respective convexities 17*d,* 17*e* of the inner-and outer-peripheral surfaces 17*b,* 17*c* of the hollow rubber members 17.

Additionally, although according to the above-described embodiment a rubber member has been used as the elastic member, the elastic member is not limited to a rubber member. The elastic member may be a coil spring, etc. In this case, a seal plate is provided between the shield terminal and the coil spring, and the waterproof between the shielded electric wire and the motor case is done through the intermediary of a seal member such as an O ring.

The entire contents of Japanese Patent Application P10-289684 (filed Oct. 12, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A shielded-electric-wire connection part structure, comprising:

a shielded electric wire having a braid wire;

an appliance main body being formed with an electric wire insertion through-hole therein for permitting the insertion and passage therethrough of the shielded electric wire at a prescribed position, the electric wire insertion through-hole having a shield connection portion and an engaging portion;

a shield connector being interposed between the electric wire insertion through-hole and the shielded electric wire so that the braid wire is connected to a prescribed position of the electric wire insertion through-hole;

an elastic member being interposed between the electric wire insertion through-hole and the shielded electric wire, the elastic member being formed with a hollow portion through which the shielded electric wire is inserted and passed, the elastic member serving to contact the shield connector with the shield connection portion; and a holding member being interposed between the electric wire insertion through-hole and the shielded electric wire, the holding member being formed with another hollow portion through which the shielded electric wire is inserted and passed, the holding member compressing the elastic member by being engaged with the engaging portion, thereby pressing the shield connector against the shield connection portion.

2. A shielded-electric-wire connection part structure according to claim 1, wherein the hollow holding member has a flexible engaging/retaining portion which is engaged with and retained by the engaging portion, at a position opposing to the engaging portion of the electric wire insertion through-hole.

3. A shielded-electric-wire connection part structure according to claim 1, wherein a slant portion is provided on the shield connection portion of the electric wire insertion through-hole; and wherein a slant portion of the shield connector is pressed against and contacted with the slant portion of the shield connection portion.

4. A shielded-electric-wire connection part structure according to claim 1, wherein the hollow elastic member is made of a rubber material;

wherein a plurality of convexities are formed on each of an inner-peripheral surface and an outer-peripheral surface of this hollow rubber member;

wherein the electric wire insertion through-hole has a seal surface;

wherein the convexities formed on the inner-peripheral surface of this hollow rubber member are respectively made freely pressure contactable with an insulating outer clothing of the shielded electric wire; and wherein the convexities formed on the outer-peripheral surface of this hollow rubber member respective convexities are respectively made freely pressure contactable with the seal surface of the electric wire insertion through-hole.

5. A shielded-electric-wire connection part structure according to claim 2, wherein the hollow elastic member is made of a rubber material;

wherein a plurality of convexities are formed on each of an inner-peripheral surface and an outer-peripheral surface of this hollow rubber member;

wherein the electric wire insertion through-hole has a seal surface;

wherein the convexities formed on the inner-peripheral surface of this hollow rubber member are respectively made freely pressure contactable with an insulating outer clothing of the shielded electric wire; and wherein the convexities formed on the outer-peripheral surface of this hollow rubber member respective convexities are respectively made freely pressure contactable with the seal surface of the electric wire insertion through-hole.

6. A shielded-electric-wire connection part structure according to claim 3, wherein the hollow elastic member is made of a rubber material;

wherein a plurality of convexities are formed on each of an inner-peripheral surface and an outer-peripheral surface of this hollow rubber member;

wherein the electric wire insertion through-hole has a seal surface;

wherein the convexities formed on the inner-peripheral surface of this hollow rubber member are respectively made freely pressure contactable with an insulating outer clothing of the shielded electric wire; and wherein the convexities formed on the outer-peripheral surface of this hollow rubber member respective convexities are respectively made freely pressure contactable with the seal surface of the electric wire insertion through-hole.

* * * * *